US006454490B1

(12) United States Patent
Murphy

(10) Patent No.: US 6,454,490 B1
(45) Date of Patent: Sep. 24, 2002

(54) METHOD AND APPARATUS FOR CUTTING RUMBLE STRIPS IN ROADS

(75) Inventor: Tim L. Murphy, Eldorado, KS (US)

(73) Assignee: Dustrol, Inc., Towanda, KS (US)

( * ) Notice: Subject to any disclaimer, the term of this patent is extended or adjusted under 35 U.S.C. 154(b) by 0 days.

(21) Appl. No.: 09/783,418

(22) Filed: Feb. 14, 2001

(51) Int. Cl.[7] ..... E01C 23/16
(52) U.S. Cl. ..... 404/94; 404/75; 404/93
(58) Field of Search ..... 404/72, 75, 90, 404/93, 94; 299/39.1, 39.3, 39.4, 39.5, 39.6, 39.9, 40.1

(56) References Cited

U.S. PATENT DOCUMENTS

| | | | | |
|---|---|---|---|---|
| 1,533,464 A | | 4/1925 | Robb | |
| 2,349,949 A | | 5/1944 | Farrell | |
| 3,414,327 A | | 12/1968 | Austin | |
| 3,697,135 A | | 10/1972 | Hatcher et al. | |
| 3,724,900 A | | 4/1973 | Hatcher et al. | |
| 3,771,831 A | | 11/1973 | Hatcher et al. | |
| 3,779,607 A | | 12/1973 | Staab | |
| 3,807,634 A | | 4/1974 | Vogt | |
| 3,829,161 A | | 8/1974 | Wirtgen | |
| 3,971,594 A | | 7/1976 | Wirtgen | |
| 4,333,685 A | | 6/1982 | Arnswald | |
| 4,333,686 A | | 6/1982 | Arnswald | |
| 4,463,989 A | | 8/1984 | Kennedy | |
| 4,701,069 A | * | 10/1987 | Whitney | 404/75 |
| 4,764,051 A | | 8/1988 | Whitney | |
| 4,909,575 A | * | 3/1990 | Lupton | 404/90 |
| 4,943,119 A | * | 7/1990 | Zarniko et al. | 404/90 |
| 4,986,604 A | * | 1/1991 | Meister | 404/90 |
| 5,094,565 A | | 3/1992 | Johnson | |
| 5,215,071 A | * | 6/1993 | Mertes et al. | 299/39 |
| 5,297,894 A | | 3/1994 | Yenick | |
| 5,391,017 A | | 2/1995 | Thomas et al. | |
| 5,415,495 A | | 5/1995 | Johnson | |
| 5,456,547 A | | 10/1995 | Thomas et al. | |
| 5,484,228 A | | 1/1996 | Thomas et al. | |
| 5,582,490 A | | 12/1996 | Murray | |
| 5,607,255 A | | 3/1997 | Thomas et al. | |
| 5,676,490 A | | 10/1997 | Nelson | |
| 5,695,299 A | | 12/1997 | Thomas et al. | |
| 5,860,764 A | * | 1/1999 | Roberts | 404/93 |
| 5,957,620 A | | 9/1999 | Thomas et al. | |
| 6,210,071 B1 | * | 3/2001 | McSharry | 404/94 |
| 6,220,783 B1 | * | 4/2001 | Maxwell | 404/94 |

FOREIGN PATENT DOCUMENTS

GB 2238562 A * 6/1991 ..... E01F/11/00

OTHER PUBLICATIONS

PennDOT Cuts Rumble Strips into Pavements, Public Works, Mar., 1973.

* cited by examiner

*Primary Examiner*—Thomas B. Will
*Assistant Examiner*—Alexandra K. Pechhold
(74) *Attorney, Agent, or Firm*—Shook, Hardy & Bacon L.L.P.

(57) ABSTRACT

An apparatus and method of using the apparatus for creating rumble strips in a surface such as asphalt or concrete, including a vehicle with an attachment coupled thereto. The attachment includes a cutter wheel having teeth thereon and a flywheel coupled with the cutter wheel. A hydraulic motor is coupled with the cutter wheel for rotating the cutter wheel and the flywheel. Eccentric cams are provided for moving the cutter wheel vertically with respect to the surface being cut, and a gear box is coupled with the eccentric cams for rotating the eccentric cams. The eccentric cams do not contact the surface being cut. The apparatus further includes a sliding assembly coupled with the cutter wheel. The sliding assembly is both horizontally and vertically movable with respect to the surface being cut.

13 Claims, 2 Drawing Sheets

METHOD AND APPARATUS FOR CUTTING RUMBLE STRIPS IN ROADS

STATEMENT REGARDING FEDERALLY SPONSORED RESEARCH OR DEVELOPMENT

Not Applicable.

CROSS-REFERENCE TO RELATED APPLICATIONS

Not Applicable.

BACKGROUND OF THE INVENTION

The present invention relates to a machine for cutting rumble strips. More particularly, this machine repetitively cuts depressions in a roadway surface at desired spacings.

Rumble strips may be used on the shoulders of roads or on highway exit ramps. Rumble strips are spaced such that when a vehicle drives over them, they make a loud sound that can be heard by the driver of the vehicle. They provide a safety function by warning a driver when he or she has left the main roadway. This is especially helpful to drivers that have fallen asleep while driving.

Some of the machines that are currently available for creating rumble strips are stationary while cutting. One disadvantage with such machines is that it takes a long time for them to cover a small area of roadway surface.

Other machines available use circular cams to drive the cutting wheel forward, thus requiring an additional mechanism for moving the cutting wheel up and down. Still other machines include eccentric cams that are continuously in contact with the surface under treatment. These eccentric cams cause a raising and lowering motion to be transferred to a cutting wheel. The disadvantage with such eccentric cams is that when the treated surface is uneven, the machine can be pushed out of alignment. Also, the cams can be damaged from contact with the ground.

To overcome the deficiencies found with conventional machines for cutting rumble strips, an energy efficient apparatus for cutting rumble strips is needed. Still further, a cutting attachment that can be moved both horizontally and vertically is needed.

SUMMARY OF THE INVENTION

It is an object of the present invention to provide a machine for creating rumble strips that conserves energy.

It is a further object of the present invention to provide a machine for cutting rumble strips that is able to cut rumble strips without interrupting the forward motion of the machine.

According to the present invention, the foregoing and other objects are achieved by an apparatus for creating rumble strips in a surface such as asphalt or concrete. This apparatus includes a vehicle with an attachment coupled therewith. The attachment includes a cutter wheel having teeth thereon, a flywheel coupled with the cutter wheel, a first hydraulic motor coupled with the cutter wheel for rotating the cutter wheel and the flywheel, eccentric cams for moving the cutter wheel vertically with respect to the surface being cut, a gear box and second hydraulic motor coupled with the eccentric cams, and a sliding assembly that is both horizontally and vertically movable with respect to the surface being cut. The sliding assembly is coupled with the cutter wheel. The eccentric cams do not contact the surface being cut. The present invention further includes a method for cutting rumble strips in a road using the apparatus described above.

Additional objects, advantages, and novel features of the invention will be set forth in the description that follows and in part will become apparent to those skilled in the art upon examination of the following, or may be learned by practice of the invention.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION OF THE PREFERRED EMBODIMENT

Figure 1:
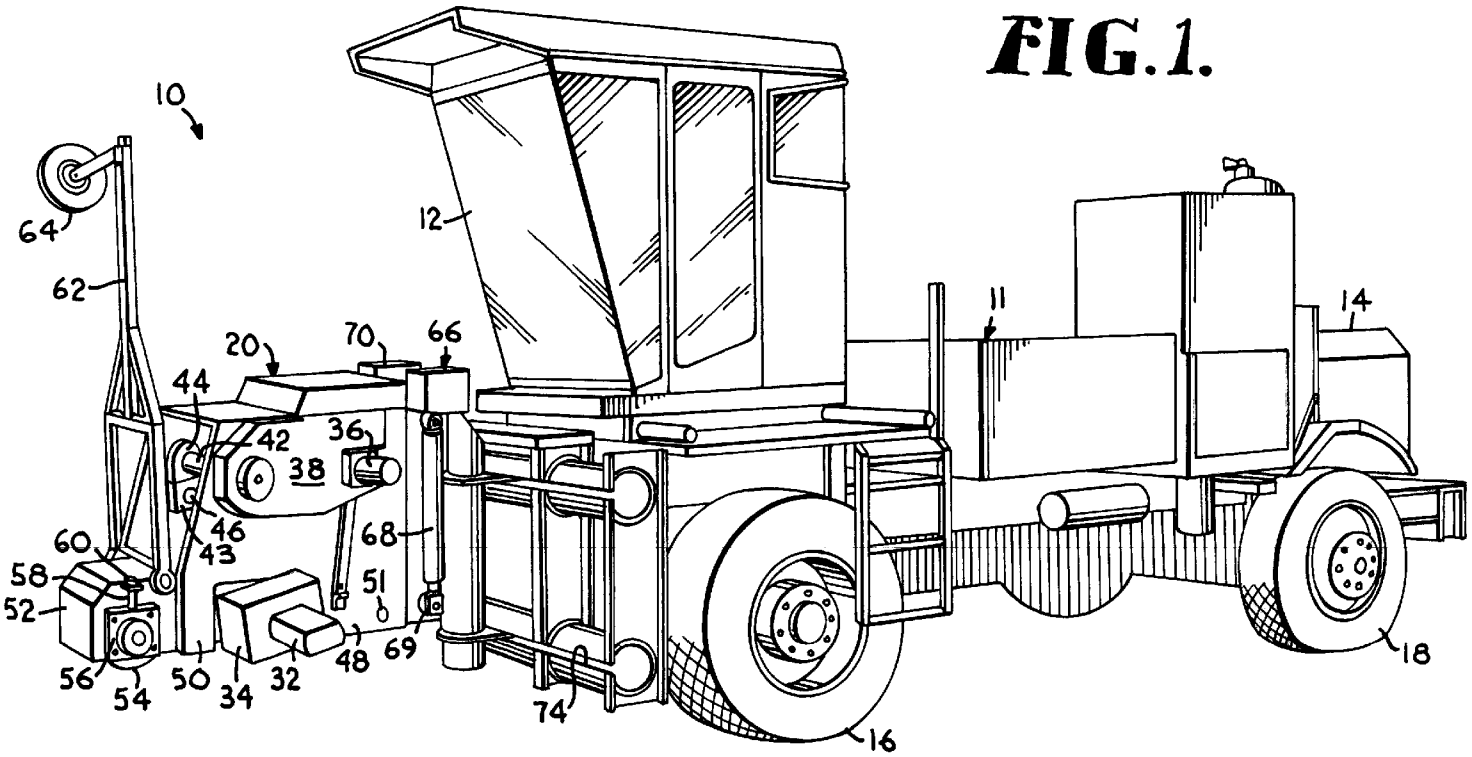
FIG. 1 is a perspective view of an apparatus for cutting rumble strips of a preferred embodiment of the present invention.

Referring to FIG. 1, an apparatus for cutting rumble strips in roads that embodies the principles of the present invention is broadly designated by the referenced numeral 10. Hydraulic lines have been left off of the figures for clarity. Apparatus 10 includes a vehicle 11 with a cab 12. Cab 12 has a control station therein. Vehicle 11 is powered by an engine 14, is driven by drive tires 16, and is controlled by steering tires 18.

Figure 5:
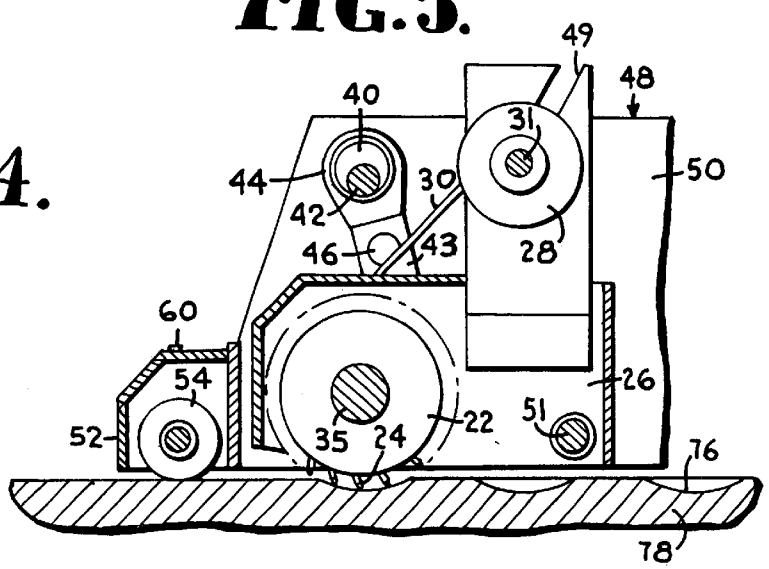
FIG. 5 is a side elevational view of the attachment of a preferred embodiment taken generally along line 5—5 of FIG. 4 wherein the cutter wheel is in a lowered position.
Figure 4:
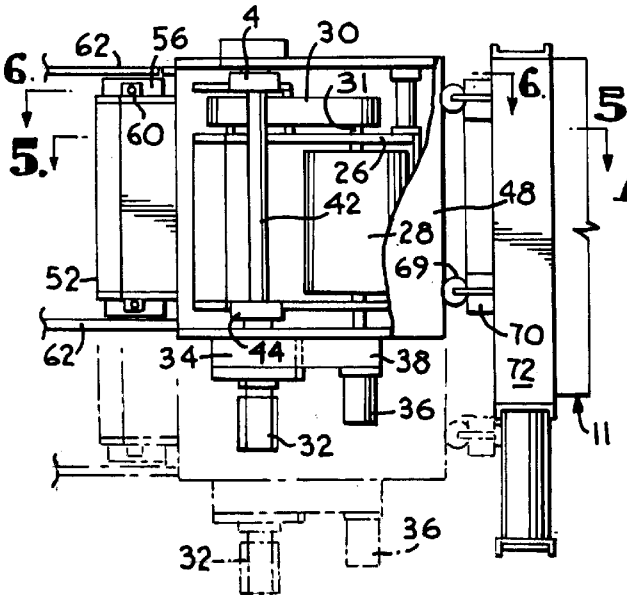
FIG. 4 is a top elevational view of the cutting attachment of a preferred embodiment of the present invention with parts broken away to reveal details of construction of the first position of the attachment and phantom lines illustrating a second position of the attachment.
Figure 6:
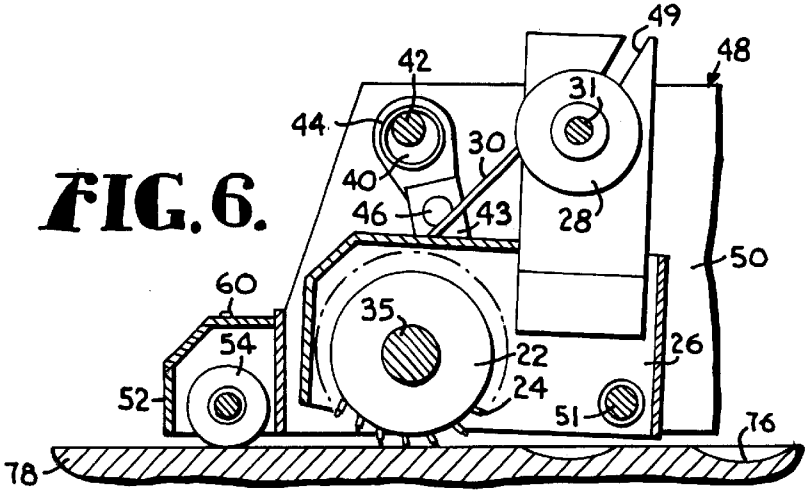
FIG. 6 is a side elevational view of the attachment of a preferred embodiment as shown in FIG. 5 wherein the cutter wheel is in a raised position.
Figure 7:
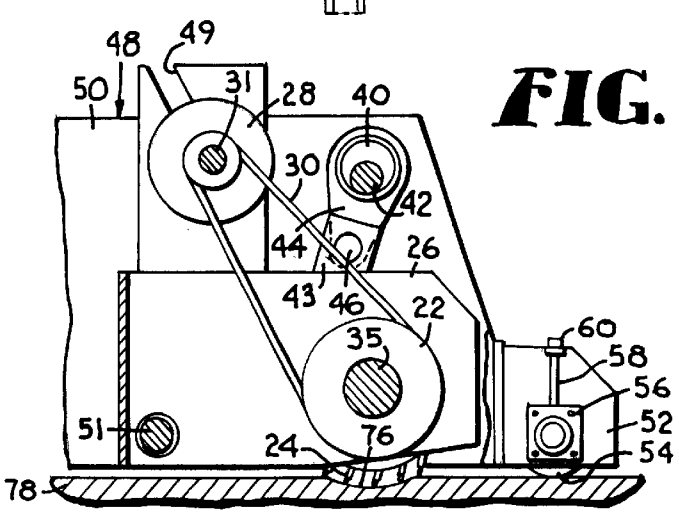
FIG. 7 is a side elevational view of the attachment of a preferred embodiment taken generally along line 7—7 of FIG. 4.

An attachment for creating rumble strips 20 is coupled with the front of vehicle 11. As best shown in FIGS. 3–7, attachment 20 includes a cutter wheel 22 with teeth 24 thereon for cutting rumble strips. Cutter wheel 22 is located within a cutter wheel box 26 and is coupled with flywheel 28 by belts 30, as best shown in FIG. 7. As shown in FIG. 1 and FIG. 4, a first hydraulic motor 32 coupled with a coupling 34 drives a shaft 35 which turns cutter wheel 22. Through belts 30, cutter wheel 22 causes flywheel 28 to rotate around shaft 31.

A second hydraulic motor 36 connected to a gear box 38 drives eccentric cams 40 via a shaft 42 on which the cams 40 are mounted. Eccentric cams are coupled with brackets 43 on cutter wheel box 26 via arms 44 which surround the cams 40 and are pivotally connected to the brackets 43 at pivot points 46, as best shown in FIGS. 5–7. As eccentric cams 40 rotate, arms 44 pivot about pivot points 46 and are moved up and down by the eccentric cams 40 to cause up and down movement of the cutter wheel box 26. Flywheel 28, eccentric cams 40, cutter wheel 22, and cutter wheel box 26 are all housed in an outer box 48 having outer side walls 50, as shown in FIGS. 4–7. Slot 49 is in cutter wheel box 26 so as to allow the flywheel 28 to be adjusted or replaced. Cutter wheel box 26 is coupled with outer box 48 via pivot point 51, as shown in FIGS. 5–7.

Referring to FIG. 7, a guide wheel box 52 is coupled with outer box 48 and houses a guide wheel 54 therein. Guide wheel 54 is coupled with a bearing 56, which is coupled with box 52. The height of guide wheel 54 can be adjusted by a threaded screw 58 coupled with bearing 56 and guide wheel box 52, using a nut 60 to hold threaded screw 58 in place.

Referring to FIG. 1, a pointer assembly 62 is coupled with guide wheel box 52. A pointer wheel 64 is coupled with pointer assembly 62. The pointer assembly 62 and the pointer wheel 64 may be raised and lowered as desired. They are shown in FIG. 1 in their raised position.

Another aspect of the present invention is a method for cutting rumble strips in a surface. In this method, the apparatus described above is provided. The cutter wheel 22 is driven hydraulically by one large pump and two motors, one on each end of cutter wheel 22. Cutter wheel 22 has regularly spaced cutting teeth which create the rumble strip 76 when lowered into the road surface 78. Cutter wheel box 26, which is coupled with cutter wheel 22, is raised and lowered by rotating eccentric cams 40. This causes the cutting wheel 22 to be raised and lowered so as to create rumble strips in surface 78 when lowered and so as not to cut into the surface when raised. In this manner, spaced rumble strips are created.

Figure 2:
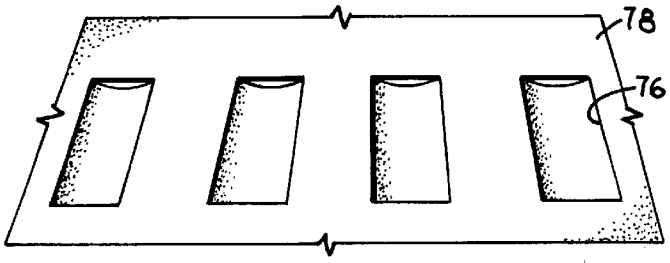
FIG. 2 is a top perspective view of rumble strips cut into asphalt by the apparatus of the present invention.
Figure 3:
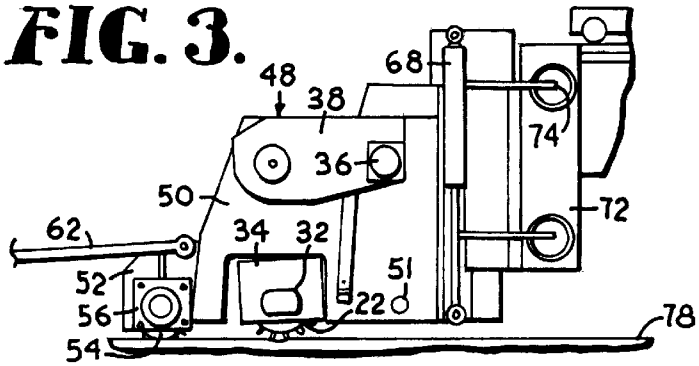
FIG. 3 is a side elevational view of the cutting attachment part of the apparatus shown in FIG. 1 with parts being broken away to reveal details of construction.

As best shown in FIG. 2, apparatus 10 creates rumble strips 76 in surface 78. The rumble strips created by the device of the present invention are usually created on asphalt or concrete roadways. This device allows multiple types and ranges of rumble strip groupings to be made depending on the rumble strips desired.

Another aspect of the present invention is a method for cutting rumble strips in a surface. In this method, the apparatus described above is provided. The cutter wheel 22 is driven hydraulically by one large pump and two motors, one on each end of cutter wheel 22. Cutter wheel 22 has regularly spaced cutting teeth which create the rumble strip 76 when lowered into the road surface 78. Cutter wheel box 26, which is coupled with cutter wheel 22, is raised and lowered by rotating eccentric cams. This causes the cutting wheel 22 to be raised and lowered so as to create rumble strips in surface 78 when lowered and so as not to cut into the surface when raised. In this manner, spaced rumble strips are created.

Eccentric cams 40 are turned by shaft 42 which is attached to gear box 38 and powered by hydraulic motor 36. As shaft 42 rotates, box 26 is raised and lowered, which allows cutter wheel 22 to create the spaced rumble strips as the chassis moves forward.

The eccentric cams 40, which raise and lower the cutter box 26, provide a positive downward pressure advantage which is designed to quickly pressure the cutter wheel 22 into the road surface 78 and then raise it quickly without interrupting the forward motion of apparatus 10 and without using excessive horsepower.

Cutter wheel 22 is turned by shaft 35 which is powered by hydraulic motor 32. Flywheel 28 is connected to cutter wheel 22 by means of V-belts 30. The rotating motion of cutter wheel 22 is transferred to shaft 31 through the V-belts 30 so as to turn flywheel 28. The flywheel provides a tremendous energy advantage when the cutter wheel 22 is lowered into the road surface. It increases the production of the machine by multiplying the available power necessary to mill rumble strips into the roadway. In this manner, flywheel 28, through its momentum, may act to turn cutter wheel 22.

Still further, apparatus 10 has a sliding assembly comprised of a vertical sliding mechanism 66 and a horizontal sliding mechanism 72. This sliding assembly enables an operator to hydraulically position cutter attachment 20 in a precise location relative to the roadway. Still further, with this sliding assembly, attachment 20 may be positioned relative to vehicle 11. The speed of the chassis, the speed of the eccentric cams 40, and the speed of the cutter wheel 22 are controlled by a ground speed controller at the operator's station.

From the foregoing, it will be seen that this invention is one well adapted to attain all the ends and objects herein above set forth together with other advantages which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

I claim:

1. An attachment for cutting rumble strips in a surface, comprising:

a cutter wheel having teeth thereon;

a flywheel coupled with said cutter wheel;

a motor coupled with said cutter wheel for rotating said cutter wheel and said flywheel;

at least one rotatable eccentric cam coupled with said cutter wheel and wherein upon rotation of said eccentric cam said cutter wheel is moved up and down by the eccentric cam with respect to said surface, and wherein said eccentric cam exerts a positive downward pressure on the cutter wheel during downward movement of the cutter wheel; and a gear box coupled with said at least one eccentric cam for rotating said eccentric cam.

2. The attachment of claim 1, wherein said eccentric cam has no contact with said surface being cut.

3. The attachment of claim 1, wherein the cutter wheel is mounted on a first shaft which is rotatably driven by said motor and the flywheel is mounted on a second shaft which is coupled with said first shaft by a belt.

4. The attachment of claim 1, wherein said gear box is coupled with said eccentric cam via a shaft.

5. The attachment of claim 1, further comprising;

a sliding assembly that is horizontally movable with respect to said surface being cut and wherein said sliding assembly is coupled with said cutter wheel so as to be able to position said cutter wheel with respect to said surface being cut.

6. The attachment of claim 5, wherein said sliding assembly is vertically movable with respect to said surface being cut.

7. A method for cutting rumble strips in a surface, comprising;

providing an apparatus for cutting rumble strips comprising a cutter wheel having teeth thereon, a flywheel coupled with said cutter wheel, a motor coupled with said cutter wheel for rotating said cutter wheel and said flywheel, an eccentric cam for moving said cutter wheel up and down with respect to said surface, and a gear box coupled with said eccentric cam for rotating said eccentric cam;

turning said cutter wheel so as to cut said surface; and rotating said eccentric cam so as to raise and lower said cutting wheel, wherein said eccentric cam has no contact with said surface being cut and wherein said cutting wheel cuts rumble strips in said surface when lowered and does not cut when raised so as to create spaced apart rumble strips as said cutter wheel is advanced along said surface, said eccentric cam exerting a positive downward pressure on the cutter wheel during said lowering of the cutting wheel.

8. The method of claim 7, wherein said surface is asphalt or concrete.

9. The method of claim 7, further comprising:

controlling the speed of said cutter wheel by using a ground speed controller.

10. The method of claim 7, further comprising:

providing a horizontal sliding mechanism coupled with said apparatus; and moving said apparatus horizontally with respect to said surface.

11. The method of claim 10, further comprising:

providing a vertical sliding mechanism coupled with said apparatus; and moving said apparatus vertically with respect to said surface.

12. An apparatus for creating rumble strips in a surface, comprising:

a vehicle comprised of an engine and at least two wheels coupled with said engine; and an attachment for cutting rumble strips coupled with said vehicle, wherein said attachment comprises a cutter wheel having teeth thereon, a flywheel coupled with said cutter wheel, a motor coupled with said cutter wheel for rotating said cutter wheel and said flywheel, an eccentric cam for moving said cutter wheel up and down with respect to said surface being cut, and a gear box coupled with said eccentric cam for rotating said eccentric cam, said eccentric cam being mounted for exerting a positive downward pressure on said cutter wheel during downward movement of the cutter wheel.

13. The apparatus of claim 12, further comprising:

a sliding assembly comprised of a horizontal sliding mechanism and a vertical sliding mechanism wherein said assembly is coupled with said vehicle and said attachment.

* * * * *